United States Patent [19]

Woodford

[11] 3,964,120

[45] June 22, 1976

[54] COMB CLEANER

[75] Inventor: Thurman R. Woodford, South Plainfield, N.J.

[73] Assignee: Lawrence Peska Associates, Inc., New York, N.Y. ; a part interest

[22] Filed: Oct. 4, 1974

[21] Appl. No.: 511,928

[52] U.S. Cl. ..... 15/104.5; 15/142; 15/172; 132/120

[51] Int. Cl.[2] ..... A45D 24/44

[58] Field of Search ..... 15/27, 104.5, 104.51, 15/104.53, 104.54, 142, 176, 187, 188, 106, 172; 132/119, 120

[56] References Cited

UNITED STATES PATENTS

| | | | |
|---|---|---|---|
| 289,550 | 12/1883 | Miles | 15/104.5 |
| 405,296 | 6/1889 | Bailey | 15/188 |
| 1,932,878 | 10/1933 | Akizawa | 15/176 |
| 2,941,228 | 6/1960 | Ritter | 15/206 X |
| 3,087,183 | 4/1963 | Semon | 15/176 X |
| 3,167,799 | 2/1965 | McKinley | 15/176 |

FOREIGN PATENTS OR APPLICATIONS

| | | | |
|---|---|---|---|
| 689,655 | 6/1930 | France | 15/188 |
| 924,209 | 3/1947 | France | 15/39 |
| 339,691 | 8/1921 | Germany | 15/167 R |

*Primary Examiner*—Daniel Blum
*Attorney, Agent, or Firm*—Jack D. Slobod

[57] ABSTRACT

A cleaner for combs which comprises a generally circular planar head having radially extending bristle tufts and hard rubber elongated tines disposed about different 180° circumferential portions. The head has a pair of spaced apart recesses which lockably receive a pair of spherical knobs upstanding from an elongated handle for securing the head to he handle in either of two opposite angular orientations to selectively expose either the bristle tufts or the elongated members for use.

2 Claims, 3 Drawing Figures

COMB CLEANER

BACKGROUND OF THE INVENTION

The invention relates to cleaning brushes and particularly to cleaning brushes for combs. The prior art includes apparatus such as that shown in Dreher, U.S. Pat. No. 2,139,940 issued Dec. 13, 1938. Such apparatus included an elongated brush having generally parallel bristles disposed along a straight member. Such apparatus has not been widely accepted and it is believed that it is desirable to provide apparatus which may be selectively urged into relationship with the teeth of a comb along different portions of the brush. Such apparatus insures that a clean section of bristle is always available.

Accordingly, it is a primary object of the invention to provide a brush for cleaning a comb which has a plurality of discrete bristle tuft and tine sections which may be selectively individually urged against the teeth of the comb.

Still another object of the invention is to provide apparatus which is simple to use and inexpensive to manufacture.

SUMMARY OF THE INVENTION

It has now been found that these and other objects of the invention may be satisfied by comb cleaning apparatus which includes a generally circular planar member having disposed at a plurality of points along the circumference thereof a plurality of bristles. Tine members may be disposed at other circumferencial points about the member.

Ordinarily the apparatus will include an elongated handle which is fixed to the generally circular member. The means for attachment of the handle to the generally circular member may include a pair of generally spherical members for cooperation with a pair of generally spherical recesses. The material used in the construction of the handle and the generally circular member may be hard rubber.

BRIEF DESCRIPTION OF THE DRAWING

The invention will be better understood by reference to the drawing in which.

DESCRIPTION OF A PREFERRED EMBODIMENT

Figure 1:
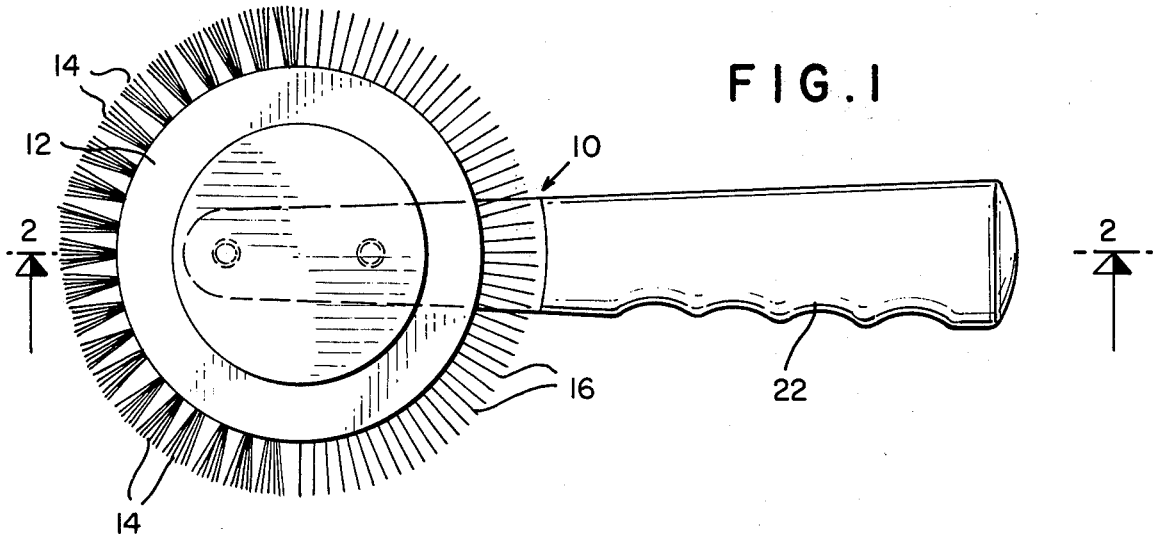
FIG. 1 is a side elevational view of the apparatus in accordance with the invention.
Figure 2:
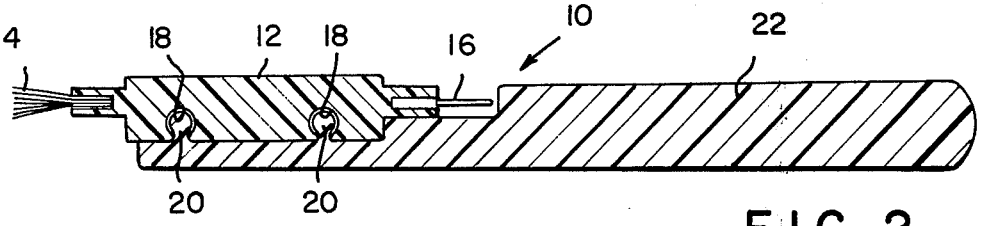
FIG. 2 is a sectional view taken through the line 2-2 of FIG. 1.
Figure 3:
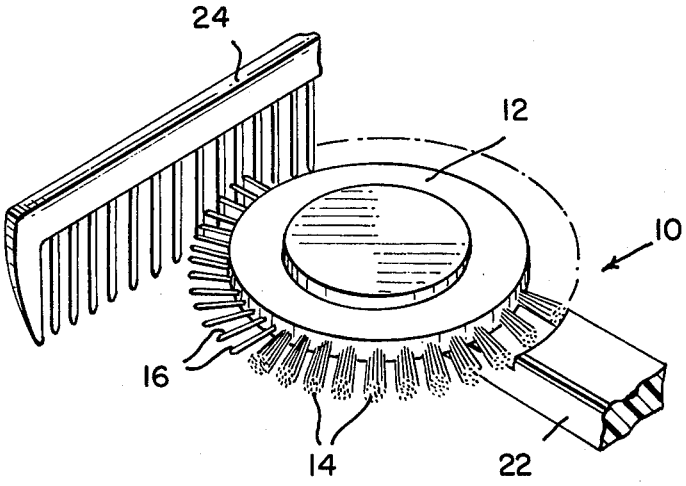
FIG. 3 is a perspective view showing a broken away portion of the apparatus shown in FIG. 1 and a comb being used therewith.

Referring now to FIGS. 1, 2 and 3 there is shown the cleaner 10 in accordance with the invention. The cleaner 10 includes a generally circular member 12 which is also generally planar and which about the circumferencial surface thereof has a plurality of discrete points, a plurality of bristles 14. Preferably the bristles 14 will extend only around 180° of the circumference of the generally circular member 12. Disposed around the remainder of the circumferencial portion of the generally circular member 12 will be a plurality of hard rubber elongated members or tines 16 carried at circumferentially spaced positions.

The generally circular member 12 normally will be provided with generally spherical recesses 18 for accommodation with generally spherical knobs 20 carried on a handle 22. The cooperating recesses and knobs 18, 20 permit the selective positioning of a given circumferencial portion of the generally circular member 12 with a comb which is to be cleaned. The handle normally will be manufactured of plastic and the generally circular member 12 may be made of hard plastic or hard rubber. The resiliency of the materials permit the selective removal and connection of the generally circular member 12 to the handle 22 in either of two discrete positions. In operation the hard rubber tips 16 may be used for cleaning an associated comb 24 and thereafter the generally circular member 12 will be indexed one hundred and eighty degrees and the bristles 14 will be urged against the associated comb 24.

Having thus described my invention I claim:

1. A comb cleaning implement comprising: a generally circular planar member having bristle tufts extending radially from a plurality of points along one half of the circumference of said member and a plurality of tines extending radially from a plurality of points along the other half of the circumference of said member, an elongated handle extending radially of said member and mutally engageable fastener means carried by said member and said handle for securing said member to said handle selectively in either of two opposite angular orientations.

2. The implement of claim 1 wherein said mutually engageable fastener means comprises a pair of spaced apart fastener means formed on said planar member, a first of said fastener means on said member located closer to said bristle tufts than the second fastener means on said member and the second fastener means located closer to said tines than the first fastener means, and wherein said handle has a pair of fastener means longitudinally spaced along said handle and engageable with the fastener means on said member.

* * * * *